US005199112A

United States Patent [19]

Locarno

[11] Patent Number: 5,199,112

[45] Date of Patent: Apr. 6, 1993

[54] RAISED SUPERIMPOSED TOILET SEAT FOR TOTAL HIP ARTHROPLASTY PATIENTS

[75] Inventor: Michael M. Locarno, Boonton, N.J.

[73] Assignee: Bel-Art Products, Inc., Pequannock, N.J.

[21] Appl. No.: 767,804

[22] Filed: Sep. 30, 1991

[51] Int. Cl.[5] ..... A47K 13/24

[52] U.S. Cl. ..... 4/239; 4/237

[58] Field of Search ..... 4/234, 235, 237, 239, 4/420, 429, 905, DIG. 6; 297/459; D23/311

[56] References Cited

U.S. PATENT DOCUMENTS

| | | | |
|---|---|---|---|
| D. 237,887 | 12/1975 | Landsberger | 4/239 X |
| D. 242,457 | 11/1976 | Landsberger | D23/311 |
| D. 287,534 | 12/1986 | Broeils | D23/311 |
| 532,656 | 1/1895 | Fryer | 4/420 |
| 4,462,122 | 7/1984 | Broeils | 4/239 |
| 4,477,932 | 10/1984 | Lenosky | 4/239 |
| 5,027,445 | 7/1991 | Locarno | 4/235 |

FOREIGN PATENT DOCUMENTS

| | | | |
|---|---|---|---|
| 1267918 | 6/1961 | France | 4/237 |

*Primary Examiner*—William A. Cuchlinski, Jr.
*Assistant Examiner*—W. Morris Worth
*Attorney, Agent, or Firm*—Anthony F. Cuoco

[57] ABSTRACT

A raised superimposed toilet seat is adapted to fit on a conventional toilet seat and is contoured to particularly meet the needs of patients who have undergone unilateral or bilateral total hip replacement procedures. The seat is contoured so that when the patient is seated thereon, the patient's legs are kept adducted in the proper position, ensuring that the patient's hips are placed with the proper amount of hip flexion and abduction to prevent hip dislocation.

5 Claims, 1 Drawing Sheet

RAISED SUPERIMPOSED TOILET SEAT FOR TOTAL HIP ARTHROPLASTY PATIENTS

BACKGROUND OF THE INVENTION

This invention relates generally to raised toilet which are superimposed upon conventional toilet bowls and which are an aid for invalids and post-surgical patients, and others who have difficulty in sitting on and raising from a conventional toilet seat. More particularly, this invention relates to a toilet seat of the type described which meets the needs of patients who have undergone unilateral or bilateral total hip arthroplasty (THA).

Raised superimposed toilet seats useful for the purposes described and now known in the art feature a right or left side sloped forward toward the floor to accommodate a particular patient's infirmity, with the other side being level to provide adequate seating support. These seats are less than adequate for post-surgical THA patients who must take the precautions of limited hip flexion and adduction to prevent hip dislocation.

Prior art toilet seats of the type described include those covered by: U.S. Pat. No. 242,457 issued to Kurt Landsberger on Nov. 23, 1976; U.S. Pat. No. 287,534 issued to John Broeils on Dec. 30, 1986; and U.S. patent application Ser. No. 179,669 filed by Kurt Landsberger on Apr. 11, 1988 and now abandoned.

The present invention is an improvement over the noted prior art toilet seats and better serves the patient's needs as will be understood from the description of the invention to follow and as ascertained by patients who have undergone either unilateral or bilateral THA surgery and by physical therapists working with such patients.

SUMMARY OF THE INVENTION

This invention contemplates a raised superimposed toilet seat for use by unilateral or bilateral total hip arthroplasty (THA) patients, wherein the seat is adapted to fit on a conventional toilet bowl and has a contoured top surface which is effective for keeping a patient's leg or legs in an abducted position, preventing internal rotation as well as adduction at the hip. The top surface has a bilateral contour. That is to say, both sides of the surface are contoured so as to bring the patient's feet closer to his/her center of gravity, thereby allowing for easier standing from a seated position on the seat. Thus, a seat configured as indicated promotes ease of transfer and enhances seating comfort for the patient.

The seat is configured to accommodate wash basin type toilets, such as found in hospitals and other health care facilities, and is adapted for use with a securing device to prevent movement when the seat is in use. The securing device can be used in conjunction with safety bars and the like to assist the patient in using the seat.

The seat is molded of a light weight plastic for easy placement, removal and portability and can be easily cleaned with common detergents, disinfectants or alcohol for enhancing its utility in a patient care environment as is desireable.

DETAILED DESCRIPTION OF THE INVENTION

Figure 1:
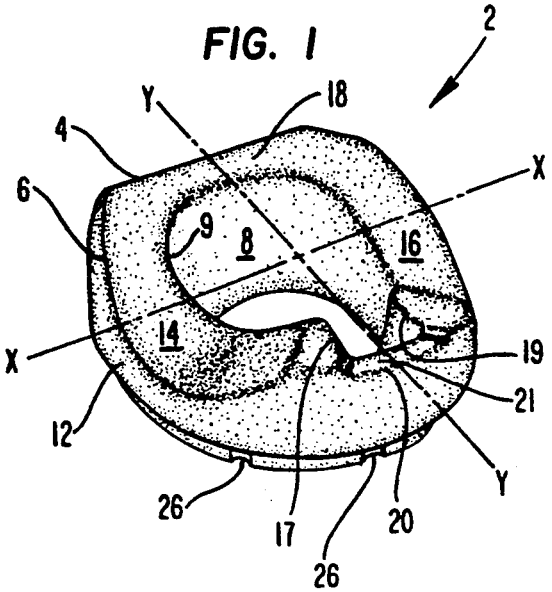
FIG. 1 is a pictorial representation of a raised superimposed toilet seat according to the invention.

With reference to the drawings, a toilet seat according to the invention is designated by the numeral 2. Seat 2 has a substantially straight back 4 and a contoured top 6. A through opening 8 is disposed substantially central to the seat. Opening 8 is generally oval in shape, and has a transverse axis X—X and a longitudinal axis Y—Y. Oval opening 8 is defined by the inner edge 9 of seat top 4. In use seat 2 is disposed on top of a conventional toilet bowl 3.

Seat 2 has a circumferentially extending wall 12 which is interrupted on either side thereof by corresponding contoured portions 14 and 16. Portions 14 and 16 are contoured to slope downwardly circumferentially from a substantially planar surface 18 near the back of seat 2, and slightly radially downwardly, outwardly from edge 9 of opening 8 to near transverse axis X—X. Forward of transverse axis, X—X, contoured portions 14 and 16 slope substantially radially downward, outwardly from edge 9 and curve upwardly circumferentially to a front 20 of contoured top 6 so as to terminate in ends 17 and 19, respectively. Ends 17 and 19 are in substantially equal spaced relation to longitudinal axis Y—Y and extend angularly rearwardly toward said axis and to edge 9. Thus, portions 14 and 16 which form contoured top 6 have a compound contour to satisfy the purposes of the invention as aforenoted.

In a typical embodiment of the invention, the height of wall 12 at back 4 is approximately 4.92 inches; the height near transverse axis X—X is approximately 2.87 inches; and the height at ends 17 and 19 is approximately 4.37 inches. The height of edge 9 at back 4 is approximately 6.63 inches; the height near transverse axis X—X is approximately 5.04 inches; and the height at ends 17 and 19 is approximately 6.28 inches.

Figure 2:
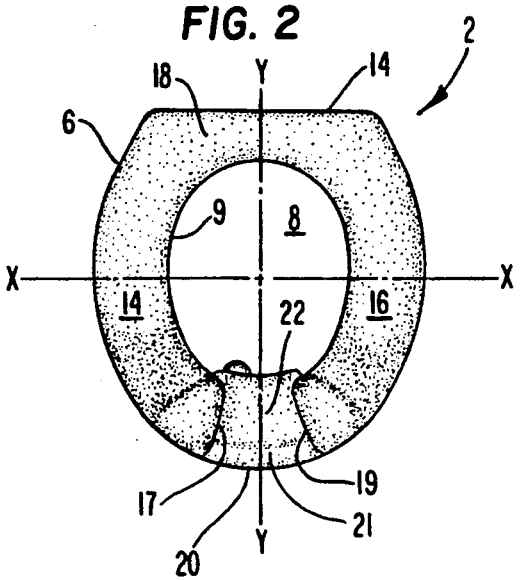
FIG. 2 is a top view thereof.

Front 20 of contoured seat top 6 has a substantially planar surface 21 lower in height than ends 17 and 19 of contoured portions 14 and 16, respectively, and which planar surface 21 separates said ends 17 and 19. A section 22 (FIG. 2) extends angularly downwardly and rearwardly from planar surface 21 and terminates below edge 9 of opening 8. Planar surface 21 and section 22 interrupt contoured portions 14 and 16 to provide clearance for facilitating use of seat 2 as will now be discerned.

Figure 3:
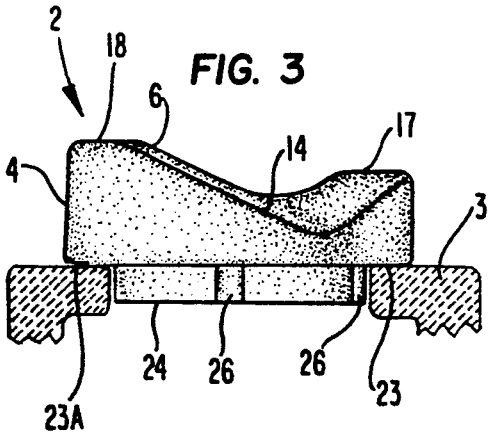
FIG. 3 is a side view thereof.
Figure 4:
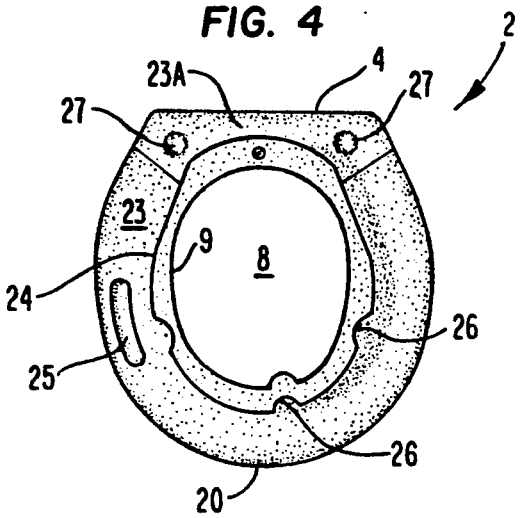
FIG. 4 is a bottom view thereof.

With particular reference to FIG. 4, underside 23 of seat 2 has as a rim 24 extending downwardly therefrom which fits into a toilet bowl 3 while seat 2 rests on the top of the toilet bowl (FIG. 3) as will be readily understood.

Rim 24 is generally oval in shape to correspond to the shape of opening 8, and opening 8 extends through said rim. Rim 24 has three cutouts 26 spaced therearound. Cutouts 26 and the general contour of rim 24 are provided to accommodate projections in toilet bowls associated with toilets commonly referred to as wash basin toilets found in hospitals and other health care facilities, and wherein projections in the bowls hold bedpans for rinsing as will be understood by those skilled in the art. Cutouts 26 provide clearance for the aforementioned projections. Thus, the use of the toilet seat herein described in health care facilities is enhanced as is desireable.

With continued reference to FIG. 4, underside 23 of seat 2 carries a pair of holes 27 disposed at opposite corners of a notched surface 23A of seat underside 23, near back 4 thereof and extending across said underside. The holes accommodate a securing clamp such as described in U.S. Pat. No. 5,027,445 issued on Jul. 2, 1991 to Michael M. Locarno. The securing clamp may be adapted to carry support members and safety bars, the same also being described in the aforenoted U.S. Pat. No. 5,027,445. The description of the clamp and support members in said patent is incorporated herein by reference.

With continued reference to FIG. 4, underside 23 of seat 2 carries a recess 28 on one side thereof, and which recess 28 is effective as a handle for carrying the seat.

There has thus been described a raised superimposed toilet seat designed to meet the needs of patients who have undergone unilateral or bilateral total hip arthroplasty (THA) procedures. When the patient is seated on the seat, the legs are kept abducted in the proper position. The seat also prevents internal rotation as well as adduction at the hip. The seat has a contoured surface to accomplish the above. Additionally, the seat promotes ease of transfer and enhances seating comfort as patients have found desireable.

With the above description of the invention in mind, reference is made to the claims appended hereto for a definition of the scope of the invention.

What is claimed is:

1. A raised toilet seat of the type which is superimposed upon a conventional toilet bowl, comprising:

a back section, a front section and a circumferentially extending wall;

a contoured top surface for supporting a user in a seated position;

a through opening disposed substantially central to the seat and defined by an inner a circumferential edge of the contoured top surface, said opening having a longitudinal axis and a transverse axis;

the wall being interrupted on either side of the longitudinal axis by corresponding contoured portions, said corresponding contoured portions providing the contoured top surface;

the corresponding contoured portions sloping downwardly circumferentially from a substantially planar surface near the seat back section and radially downward, outwardly from the inner edge of the contoured top surface to hear the transverse axis, and forward of the transverse axis the corresponding contoured seat portions sloping radially downward, outwardly from said edge and curving upwardly circumferentially to terminate in ends near the seat front section;

the back and front sections, the contoured top surface and the circumferential wall forming a seat top, said seat top having an underside, and the underside having a rim extending downwardly therefrom, said rim extending into the toilet bowl while the seat rests on top of said bowl;

the underside having a notched surface near the back of the seat and extending across said underside, a pair of holes provided in said notched surface, each of which holes of the pair of holes is disposed at a corner of the notched surface, and said holes accommodating a securing clamp for securing the raised superimposed toilet seat to the toilet;

the contour of the corresponding contoured portions being effective for keeping a user's legs in an abducted position, preventing internal rotation as well as adduction at the user's hips; and said corresponding contoured portions on either side of the longitudinal axis providing a bilateral contour on the top surface whereby the user's feet are closer to the user's center of gravity to enhance seating comfort and to facilitate standing of the user from a seated position on the seat.

2. A raised superimposed toilet seat as described by claim 1, wherein:

the ends of the contoured seat portions are in substantially equal spaced relation to the longitudinal axis and extend angularly rearwardly toward said longitudinal axis to the edge of the opening.

3. A raised superimposed toilet seat as described by claim 2, wherein:

the seat front section has a planar surface lower in height than the ends of the contoured seat portions and separating said ends;

a section extends angularly downwardly and rearwardly from the front section planar surface; and said front section planar surface and said angularly downwardly extending section interrupt the corresponding contoured seat portions to provide a clearance for facilitating use of the seat by the user.

4. A raised superimposed toilet seat as described by claim 1, wherein:

the toilet is of the wash basin type having projections within the bowl thereof; and the rim has a plurality of cut-outs spaced therearound to provide clearance for the projections.

5. A raised superimposed toilet seat as described by claim 1, including:

a recess in the underside on one side thereof, said recess being effective as a handle for the raised superimposed toilet seat.

* * * * *